US008519810B2

(12) United States Patent
Ruan et al.

(10) Patent No.: US 8,519,810 B2
(45) Date of Patent: Aug. 27, 2013

(54) MICRO-MAGNETIC PROXIMITY SENSOR AND METHOD OF OPERATING SAME

(76) Inventors: Meichun Ruan, San Tan Valley, AZ (US); Qunying Wei, San Tan Valley, AZ (US)

( * ) Notice: Subject to any disclaimer, the term of this patent is extended or adjusted under 35 U.S.C. 154(b) by 0 days.

(21) Appl. No.: 13/506,323

(22) Filed: Apr. 11, 2012

(65) Prior Publication Data

US 2012/0242435 A1 Sep. 27, 2012

Related U.S. Application Data

(62) Division of application No. 12/584,963, filed on Sep. 14, 2009, now Pat. No. 8,159,320.

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 4,161,685 | A * | 7/1979 | Jacob | 323/351 |
| 5,475,353 | A | 12/1995 | Roshen et al. | |
| 5,557,132 | A | 9/1996 | Takahashi | |
| 5,703,550 | A | 12/1997 | Pawlak et al. | |
| 5,818,316 | A | 10/1998 | Shen et al. | |
| 5,847,631 | A | 12/1998 | Taylor et al. | |
| 5,872,496 | A | 2/1999 | Asada et al. | |
| 5,889,452 | A | 3/1999 | Vuilleumier | |
| 5,945,898 | A | 8/1999 | Judy et al. | |
| 6,084,281 | A | 7/2000 | Fullin et al. | |
| 6,094,116 | A | 7/2000 | Tai et al. | |
| 6,124,650 | A | 9/2000 | Bishop et al. | |
| 6,469,602 | B2 | 10/2002 | Ruan et al. | |
| 6,469,603 | B1 | 10/2002 | Ruan et al. | |
| 6,492,887 | B1 | 12/2002 | Diem et al. | |
| 6,633,158 | B1 | 10/2003 | Shen et al. | |
| 6,794,965 | B2 | 9/2004 | Shen et al. | |
| 7,106,159 | B2 | 9/2006 | Delamare et al. | |
| 7,301,334 | B2 | 11/2007 | Shen et al. | |
| 7,372,349 | B2 * | 5/2008 | Wheeler et al. | 335/78 |
| 7,482,899 | B2 | 1/2009 | Shen et al. | |
| 8,159,320 | B2 | 4/2012 | Ruan et al. | |
| 2005/0007218 | A1 | 1/2005 | Shen et al. | |
| 2008/0231930 | A1 | 9/2008 | Mizoguchi et al. | |
| 2010/0141366 | A1 | 6/2010 | Sprague et al. | |

* cited by examiner

*Primary Examiner* — Bernard Rojas

(57) ABSTRACT

A micro-machined magnetic relay has a moveable cantilever comprising a soft magnetic material and having a first end and a second end. The cantilever has a rotational axis which is a flexure supported by a substrate. The cantilever has a first state and a second state. A first permanent magnet is disposed near the first end of the cantilever to force the cantilever in the first state. A second movable magnet causes changes of magnetic forces and torques on the cantilever. Therefore, the direction of a sum of torque on the cantilever is reversed. As a result, the cantilever flips from the first state to the second state. The relay can be used as a proximity sensor to detect the motion of an object associated with the second movable magnet.

20 Claims, 8 Drawing Sheets

MICRO-MAGNETIC PROXIMITY SENSOR AND METHOD OF OPERATING SAME

CROSS-REFERENCE TO RELATED APPLICATIONS

This application is a divisional application of U.S. Ser. No. 12/584,963, filed on Sep. 14, 2009, now U.S. Pat. No. 8,159,320, which is hereby incorporated by reference.

FEDERALLY SPONSORED RESEARCH

Not Applicable

FIELD OF THE INVENTION

The present invention relates to electronically switching relays. More specifically, the present invention relates to micro-magnetic relays and to methods of formulating and operating micro-magnetic relays in proximity sensor systems.

BACKGROUND OF THE INVENTION

Relays are typically electrically controlled devices that open and close electrical contacts to affect the current flow in an electrical circuit or the laser path in the fiber optical system. Relays are widely used in telecommunications, radio frequency (RF) communications, portable electronics, consumer and industrial electronics, aerospace, optical fiber communications, and proximity sensing systems.

A common electro-mechanical relay comprises an electromagnetic mechanism, an armature, and a contact mechanism having a fixed contact and a movable contact which are selectively closed and opened by a pivot motion of the armature. Conventional mechanical relays are manufactured individually and they are large in size. As a trend of the industry, some applications including automated testing, telecommunications and consumer electronics require higher density of relay deployment. Large size relay no longer meets the requirements.

Micro-electro-mechanical systems (MEMS) technologies provide new manufacturing methods to make micro relays. A bi-stable, latching relay that does not require power to hold the states is therefore desired. Various designs of micro magnetic relay have been disclosed.

A non-volatile programmable switch is described in U.S. Pat. No. 5,818,316 issued to Shen et al. on Oct. 6, 1998, the entirety of which is incorporated herein by reference. The switch disclosed in this reference includes first and second magnetizable conductors. The first conductor is permanently magnetized and the second conductor is switchable in response to a magnetic field applied thereto. Programming means are associated with the second conductor for switchably magnetizing the second conductor so that magnetic attraction or repulsion force can be achieved.

Another non-volatile micro relay is described in U.S. Pat. No. 6,124,650 issued to Bishop et al. on Sep. 26, 2000, the entirety of which is incorporated herein by reference. The relay employs a square-loop latchable magnetic material with its magnetization direction being changed in response to an external magnetic field. A conductor assembly creates the external magnetic field to switch the magnetic material to the desired polarization. The attractive or repulsive force between the magnetic poles keeps the switch in the closed or open state.

Yet another non-volatile micro actuator is described in U.S. Pat. No. 7,106,159 issued to Delamare et al. on Sep. 12, 2006, the entirety of which is incorporated herein by reference. The device disclosed in this reference employs a mobile permanent magnet which can be switched from one attraction zone to the other by selectively heating one of the fixed magnetic parts above the Curie temperature. Lateral contact is made when the switch closes.

Yet another non-volatile micro relay is described in U.S. Pat. No. 7,482,899 issued to Shen et al. on Jan. 27, 2009, the entirety of which is incorporated herein by reference. The device disclosed in this reference employs thin permanent magnet deposited on the movable cantilever. By selecting the polarity of the coil current, a momentarily coil current generated perpendicular magnetic field forces the cantilever to rotate to one of its two stable positions.

Each of the prior arts, though providing a unique approach to make latching electromechanical relays and possessing some advantages, has some drawbacks and limitations. Some of them only produce very small contact force limited by the material. Some of them may require large current for switching. Some require precise placement of the mobile magnet or direct manufacturing of the mobile permanent magnet on the movable structure which requires high temperature and high pressure. In general, permanent magnet with high temperature stability is brittle and easy to break. It could become a reliability concern if it is used as a moving part which experiences millions of cycles of impact during the service. These drawbacks and limitations can make manufacturing difficult and costly, and hinder their value in practical applications.

Yet another latching relay is described in U.S. Pat. No. 6,469,602 B2 (and its continuation patents) issued to Ruan et al. on Oct. 22, 2002, the entirety of which is incorporated herein by reference. The relay disclosed in this reference includes one soft magnetic cantilever, one substantial planar magnet with its magnetic field perpendicular to the cantilever's neutral position plane, and an electromagnet or a coil to provide the switching field. The magnetic cantilever exhibits a first state corresponding to the open state of the relay and a second state corresponding to the closed state of the relay. The perpendicular magnetic field from the magnet induces a magnetic torque in the cantilever, and the cantilever may be switched between the first state and the second state with a second magnetic field generated by a coil formed on a substrate of the relay. The physics is that a magnetic moment m (a vector) of the soft magnetic cantilever experiences a torque in an approximately uniform magnetic field B (also a vector), and the magnetic torque equals $m \times B$ (cross product of two vectors). As a result, the torque tends to rotate and align the cantilever with the external magnetic field lines. Other applications like sensors were also found based on this invention.

To operate the device properly, the cantilever needs to be in an approximately uniform magnetic field. Thus it requires the length of magnet to be substantially larger than the cantilever's length to provide the approximately uniform perpendicular field to actuate the cantilever. Or it needs to be positioned far away from the magnet to get the relative uniform field, which is often weak and results in undesirable performance of the device. Special techniques can be used to generate a uniform magnetic field. But a substantial size magnet is always needed, which causes long range magnetic field interference on the neighboring relays, magnetic devices or tools. Due to the magnetic interference, the dense deployment of the relays on the printed circuit board is prohibited. Shrinking the device size, especially the magnet, is difficult. The reason is that aligning the cantilever with the magnetic field line, which curves dramatically and often points in different directions near small magnets, becomes impractical.

When the magnet is small, the nearby soft magnetic cantilever sees an extraordinary non-uniform magnetic field B in terms of its magnitude and direction. Therefore, the gradient of the magnetic field is significant and the magnetic force $(m\cdot\nabla)B$ (dot product of vector m and the gradient of vector B) dominates the movement of the cantilever. The magnetic torque $m\times B$ becomes secondary. Therefore, it is an object of the present invention to provide a relay that fully utilizes both the magnetic force $(m\cdot\nabla)B$ and torque $m\times B$. It is also the object of the present invention to provide a new type of latching micro relay that has: high contact force, small magnet size, low magnetic cross interference, small device size, high device density, high reliability, and high tolerance of process variation in the manufacture. The new relay should be easy to switch and manufacture.

SUMMARY OF THE INVENTION

According to various embodiments of the invention, a MEMS bi-stable relay fabricated using semiconductor manufacturing process employs a movable cantilever comprising soft magnetic material. The cantilever has a first end and a second end, and it is controllable to rotate clockwise or counter-clockwise around a flexure supported by a substrate. A first permanent magnet and a second permanent magnet are disposed near the first end and the second end of the cantilever respectively. For each magnet with a north pole and a south pole, only one magnetic pole, compared with its opposite pole, is arranged to dominate the interaction between the magnet and the cantilever. Each magnet produces a magnetic force and a torque about the flexure on the cantilever. The two magnets and the substrate are arranged with the cantilever such that, the cantilever has a first stable position and a second stable position corresponding to two stable states: the closed state and the open state respectively.

An electromagnet is disposed in spaced relation to the cantilever. By applying a temporary current in the electromagnet, it generates a temporary switching magnetic field to change local magnetizations of the soft magnetic material of the cantilever. The magnetic forces on cantilever and torques about the flexure change accordingly. As a result, the direction of a sum of torque, which is the total sum of all torques applied on cantilever, is reversed. Hence, the cantilever is forced to switch from one stable state to the other. After the cantilever is switched to one of the two stable states, no power in the electromagnet is further needed to maintain the stable open or closed state. By altering the direction of the current pulse in the electromagnet, the magnetic cantilever can be switched between two stable states.

BRIEF DESCRIPTION OF THE DRAWINGS

The above and other features and advantages of the present invention are hereinafter described in the following detailed description of illustrative embodiments to be read in conjunction with the accompanying drawing figures, wherein like reference numerals are used to identify the same or similar parts in the similar views, and.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application. Moreover, it should be understood that the spatial descriptions made herein are for purposes of illustration only, and that practical latching relays may be spatially arranged in any orientation or manner. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein. Arrays of these relays can also be formed by connecting them in appropriate ways and with appropriate devices.

A Latching Relay

Figure 1A:
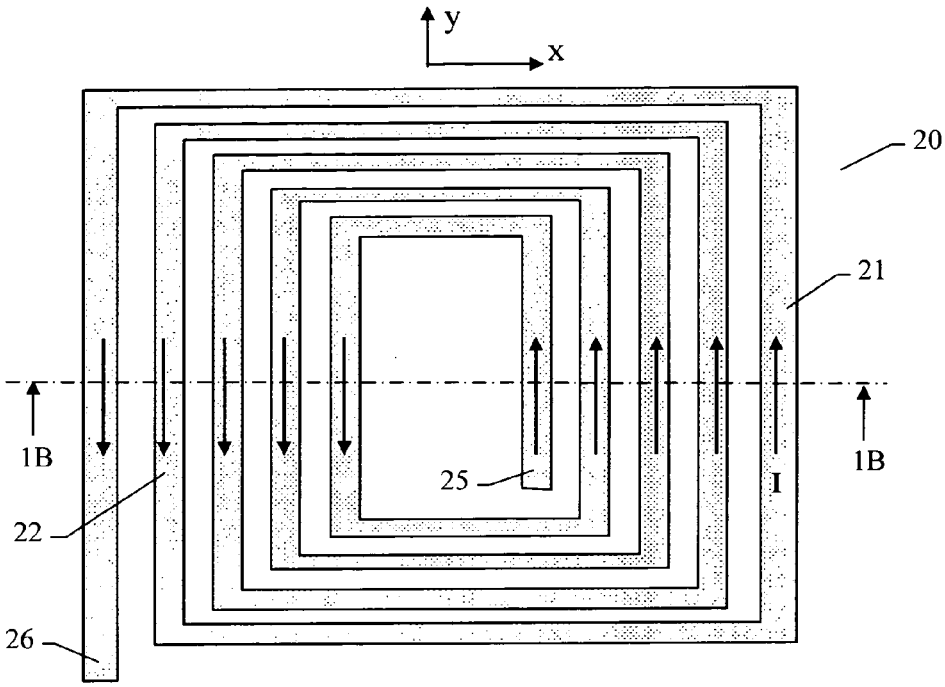
FIG. 1A is a top view of an planar coil as an electromagnet.
Figure 1B:
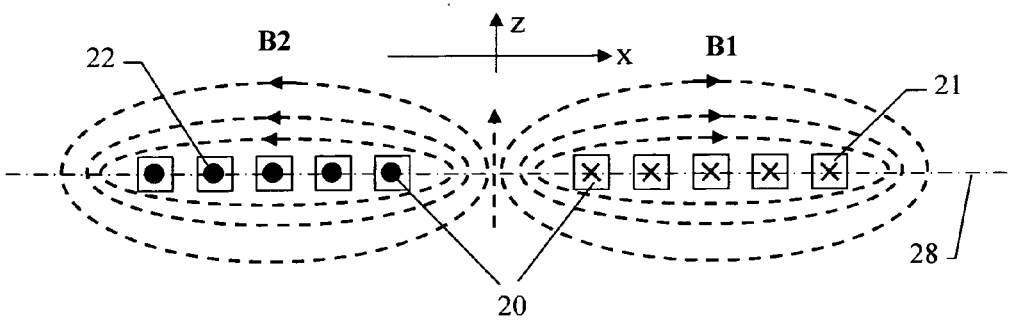
FIG. 1B is a cross sectional view of an electromagnet of FIG. 1A along line 1B.
Figure 1C:
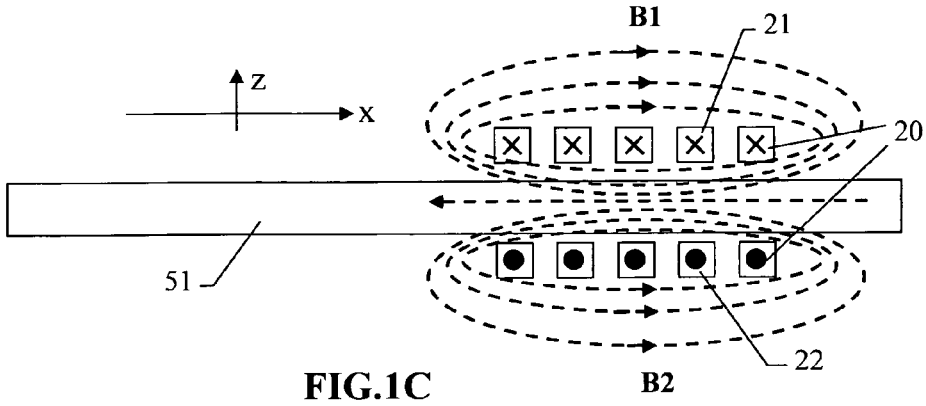
FIG. 1C is a side view of coil winding as an electromagnet.

FIGS. 1A and 1B are top and cross sectional views of an electromagnet, which is a planar coil 20 with electrical current flowing inside from input end 25 to output end 26. Coil 20 generates magnetic field B nearby. As depicted in FIGS. 1A and 1B, the current direction in the right side segments 21 is opposite to the current direction in the left side segments 22. Hence, the vector direction of the magnetic field B1 near the top surface of the right side of coil 20 is opposite to the magnetic field B2 near the top surface of the left side of coil 20. It should be appreciated that, near the top surface of coil 20, the magnetic field vector direction is approximately parallel to the plane 28 of coil 20 as depicted in FIG. 1B. By reversing the current direction in coil 20, local magnetic field B vector direction is also reversed. FIG. 1C is a side view of a coil winding, which is another type of electromagnet 20 with three dimensional windings wrapped around substrate 51.

Figure 2A:
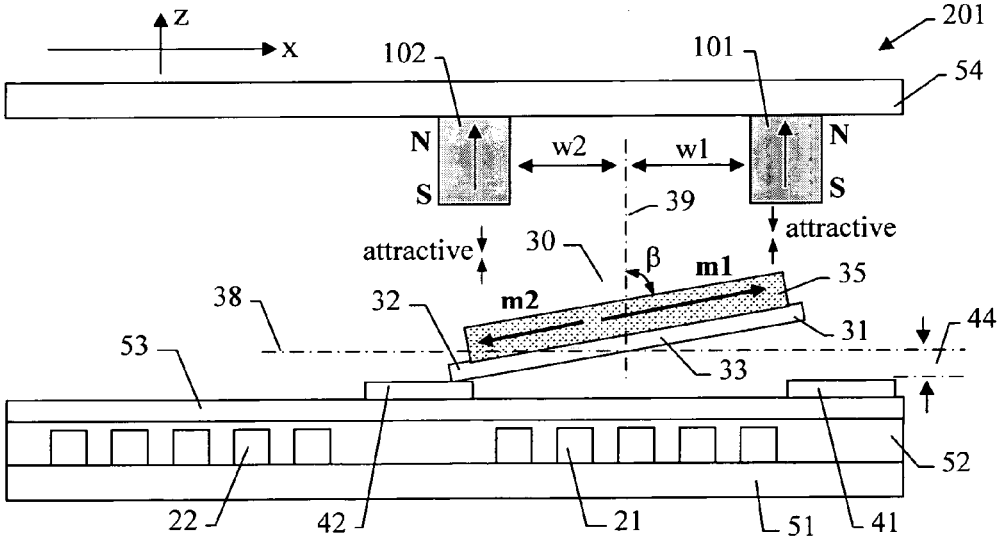
FIG. 2A is a side view of a first exemplary embodiment of the present invention in which the latching relay is in a stable open state.
Figure 2B:
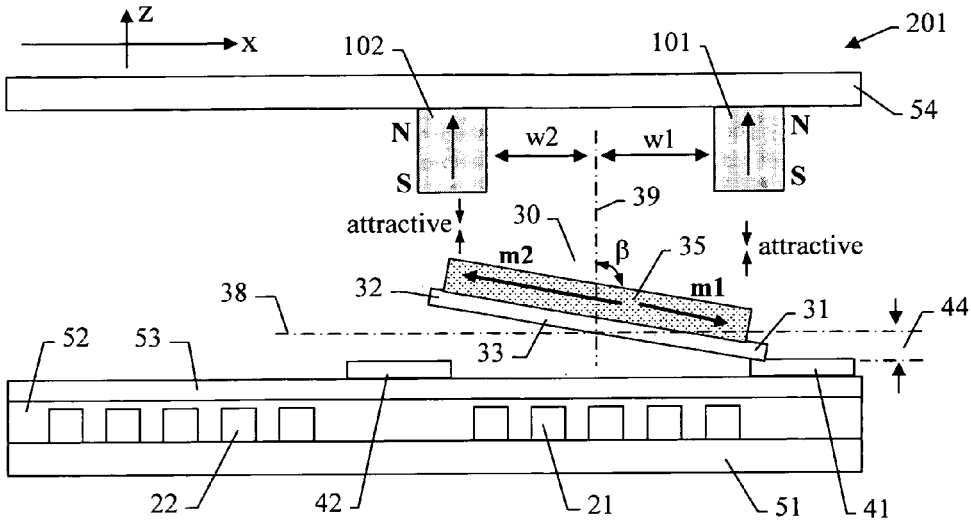
FIG. 2B is a side view of a first exemplary embodiment of the present invention in which the latching relay is in a stable closed state.
Figure 2C:
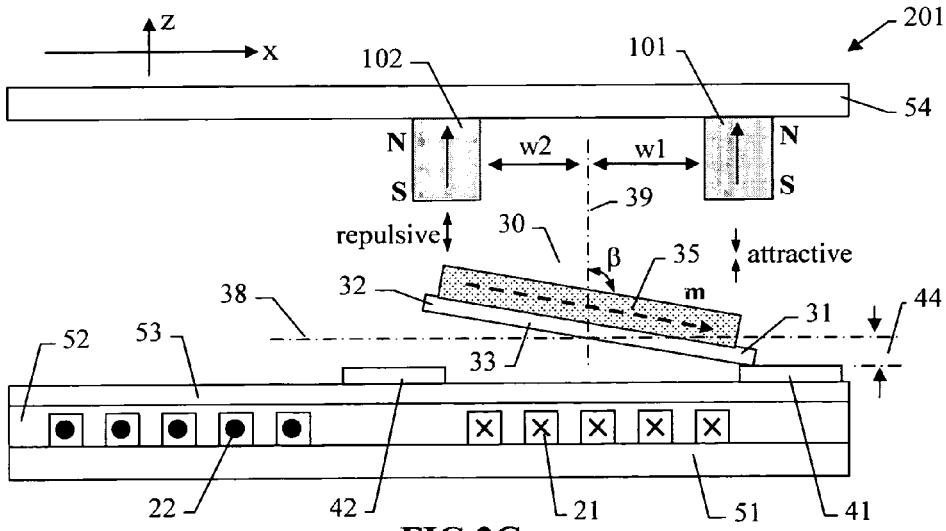
FIG. 2C is a side view of a first exemplary embodiment of the present invention in which a positive current pulse is applied in a electromagnet to switch the relay from a closed state to an open state.
Figure 2D:
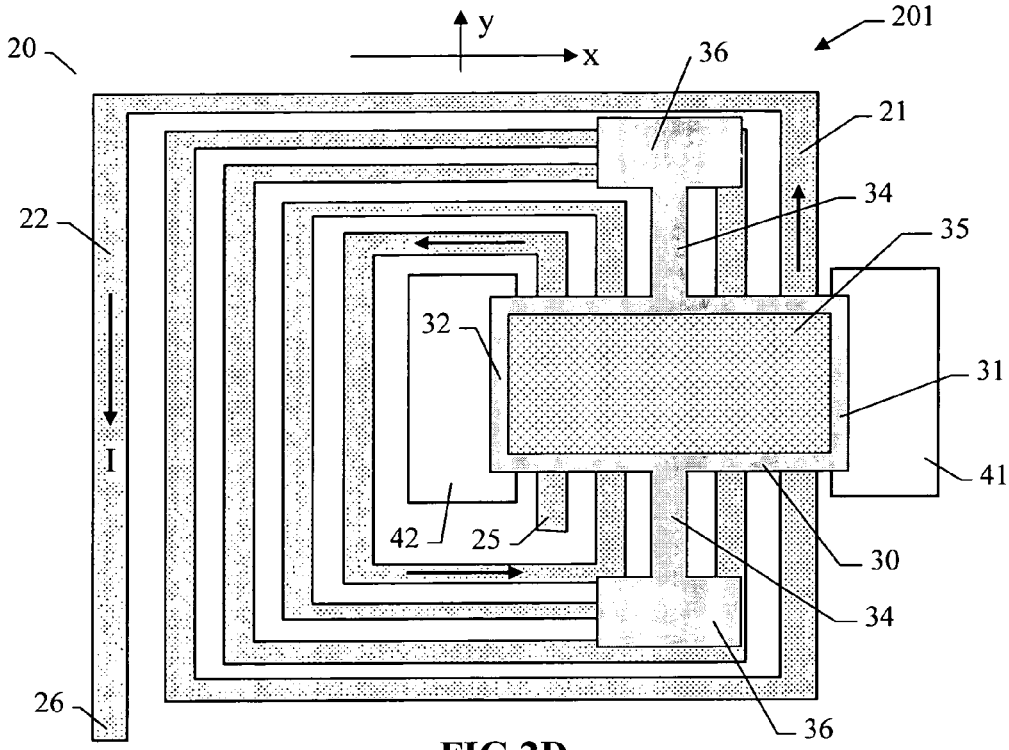
FIG. 2D is a top view of a first exemplary embodiment of the present invention.

FIGS. 2A-C are side views of the first exemplary embodiment of a latching relay 201. Relay 201 suitably includes: a substrate 51; an insulating layer 52; an electromagnet 20, which is a planar coil 20 in this embodiment; a second insulating layer 53 with conductive contacts 41 and 42 arranged on its top; a first permanent magnet 101 and a second permanent magnet 102 mounted under cap layer 54; and a moveable element 30, which is a cantilever 30 positioned above contacts 41 and 42, and below magnets 101 and 102. FIG. 2D is a top view of the first exemplary embodiment of a latching relay 201. Permanent magnets 101 and 102, insulating layers 52 and 53, and cap layer 54 are not shown in FIG. 2D.

Cap layer 54 is any type of material capable of supporting magnets 101 and 102. Suitable materials are glass, silicon, ceramics, metal or the like. The thickness can be on the order of 10-5000 microns.

First permanent magnet 101 and second permanent magnet 102 are any type of permanent magnets and they are all magnetized in positive Z-axis direction. Suitable materials with high remnant magnetization (e.g. from 0.01 Tesla to 2 Tesla) and high coercive force (e.g>100 Oersted) are commercially available such as Sm—Co, Nd—Fe—B, Fe—Al—Ni—Co, ceramic magnets and others. Sm—Co based material is preferred because of its high temperature stability and high magnetic strength. Besides being mounted under cap layer 54 as shown in FIG. 2A, magnets 101 and 102 can also be embedded inside cap layer 54. They can also be placed on top surface of cap layer 54. Magnets 101 and 102 can be individually attached to cap layer 54. They can also be batch fabricated on cap layer 54 using screen printing, mold filling, electroplating, and other process techniques.

Substrate 51 is formed of any type of substrate material such as silicon, gallium arsenide, glass, ceramics, plastic, epoxy based material, metal, or soft magnetic materials like Ni, Fe, Ni—Fe alloys, Ni—Fe—Co alloys, Ni—Co alloys, Fe—Si alloys, etc. In various embodiments, substrate 51 may be coated with an insulating material (such as an oxide) and planarized or otherwise made flat. A number of latching relays 201 may share a single substrate 51. Alternatively, other devices (such as transistors, diodes, or other electronic devices) could be formed upon substrate 51 along with one or more relays 201 using, for example, conventional integrated circuit manufacturing techniques.

Insulating layer 52 or 53 is formed of any material such as glass, high resistivity silicon, gallium arsenide, alumina ceramic, PECVD oxide, spin-on-glass, nitride, polyimide, Kapton, Teflon or other insulator. Each of insulating layer 52 and 53 has the thickness ranging from 0.1 to 1000 microns. In an exemplary embodiment, insulating layer 52 housing coil 20 is formed of PECVD silicon oxide.

Electromagnet 20 shown in FIGS. 2A to 2D is a planar coil 20 having input end 25 and output end 26. Alternative embodiments of electromagnet 20 can be single or multiple conducting segments arranged in any suitable pattern such as a meander pattern, a serpentine pattern, a random pattern, three dimensional winding or any other pattern. Electromagnet 20 is formed of any material capable of conducting electricity such as gold, silver, copper, aluminum, metal or the like. When electromagnet 20 conducts electricity, a magnetic field is generated around electromagnet 20. To generate a stronger magnetic field, besides increasing the turn number and conducting segment density of coil 20, multiple layers of coil 20 can be built on top of each other with proper insulation and wiring through vias.

Conductive contacts 41 and 42 are placed on insulating layer 53, as appropriate. Contacts 41 and 42 may be formed of any conducting material such as gold, gold alloy, silver, copper, aluminum, tungsten, ruthenium, rhodium, platinum, palladium, alloys, metal or the like.

Cantilever 30 is a seesaw style armature that is capable of being affected by magnetic force. In the embodiment shown in FIGS. 2A to 2D, cantilever 30 suitably includes a soft magnetic layer 35, a conducting layer 33 with conductive contacts 31 and 32 at each end, and a flexure 34 with anchor support 36 disposed on insulating layer 53. Flexure 34 serves as a rotational axis for cantilever 30 to rotate clockwise or counter clockwise. Soft magnetic layer 35 may be formulated of Ni—Fe alloy (permalloy), Ni, Fe, Ni—Co alloy, Ni—Fe—Co alloy, Ni—Mo—Fe alloy (supermalloy) or any other soft magnetic material. Conducting layer 33 may be formulated of gold, silver, copper, titanium, aluminum, tungsten, ruthenium, rhodium, platinum, palladium, metal, metal alloys or any other conducting material.

Cantilever 30 exhibits two states corresponding to open and closed states, as described more fully below. In many embodiments, relay 201 is said to be "closed" when a conducting layer 33 connects contact 31 to contact 41 as shown in FIG. 2B. Conversely, the relay may be said to be "open" when cantilever 30 is not in electrical contact with contact 41. A stable open state is defined when cantilever 30 tilts around flexure 34 such that conducting layer 33 connects contact 32 to contact 42 as shown in FIG. 2A. Because cantilever 30 may physically move in and out of contact with contact 41, various embodiments of flexure 34 will be made flexible so that cantilever 30 can rotate or move as appropriate. Flexibility may be created by varying the thickness, length and width of flexure 13 (or its various component layers), by patterning into different shapes, or by using flexible materials. Although of course the dimensions of cantilever 30 may vary dramatically from implementation to implementation, an exemplary cantilever 30 suitable for use in a micro-magnetic relay 201 may be on the order of 10-5000 microns in length, 10-5000 microns in width, and 1-100 microns in thickness. For example, an exemplary cantilever in accordance with the embodiment shown in FIGS. 2A-D may have dimensions along X, Y, Z-axis of 400 microns×400 microns×10 microns, or 1000 microns×800 microns×20 microns, or any other suitable dimensions.

Anchor 36 supports cantilever 30 above contacts 41 and 42 through flexure 34, creating a gap 44 that may be vacuum or may be filled with air, nitrogen, helium, or another gas or liquid such as oil. Although the size of gap 44 varies widely with different implementations, an exemplary gap 44 may be on the order of 0.1-100 microns, such as about 10 microns.

In a symmetrical design when flexure 34 is located in the center of the length (along X-axis) of cantilever 30, the two magnets 101 and 102 are of the same material, same magnetic characteristics, and same size. They are place above cantilever 30 such that, distance w1 (w1>0 meter) from magnet 101 to center line 39 of cantilever 30 is about the same as distance w2 (w2>0 meter) from magnet 102 to center line 39. Center line 39 is parallel to the Z-axis and passes through the center point of cantilever 30. In fabrication, there are misalignments and errors. Hence the magnet sizes are approximately equal under certain process specification. Distances w1 and w2 may also have some percentage of difference, for example 10%. It should be appreciated that the equality of the sizes of magnet 101 and 102, and the equality of the distances of w1 and w2 are desired for the best performance of the device. But they are not necessary for the device to function. Certain design and process variation window can be tolerated by the nature of the present invention.

For some applications, asymmetrical design might be desired to accomplish higher contact force, larger cantilever 30 rotation angle or light reflection angle, or less RF radiation in the signal path. Therefore, flexure 34 may not be necessary in the center of cantilever 30. Magnets 101 and 102 are not necessary of same size. Distances w1 and w2 may also be different.

Principle of Operation

Referring now to FIGS. 2A-D, for easy explanation, soft magnetic layer 35 is assumed to be a high permeability magnetic material like permalloy. Substrate 51 is assumed to be a regular non-magnetic material like silicon (the soft magnetic substrate 51 will be discussed later). Magnets 101 and 102 are assumed to be identical, and distances w1 and w2 are same. Additionally, flexure 34 is located in the center of the length (along X-axis) of cantilever 30.

As shown in FIG. 2A and FIG. 2B, when there is no current in coil 20, the first magnetic force between magnet 101 and magnetic layer 35 is attractive. Because the right side half of magnetic layer 35 is closer to magnet 101 than the left side half of magnetic layer 35, it contributes the majority of the first magnetic force. Furthermore, compared with the north pole of magnet 101, the south pole of magnet 101 is the dominant magnetic pole and contributes the majority of the first magnetic force since it is closer to magnetic layer 35. Similarly, when the power of coil 20 is off, the second magnetic force between magnet 102 and magnetic layer 35 is also attractive. Magnetic layer 35's left side half contributes the majority of the second magnetic force. And the south pole of magnet 102 is the dominant magnetic pole and contributes the majority of the second magnetic force compared with the north pole of magnet 102.

Cantilever 30 exhibits two stable states. The first stable state is the closed state when contact 31 touches contact 41 as shown in FIG. 2B.

At the closed state of FIG. 2B, since the gap between magnet 101 and magnetic layer 35 is larger than the gap between magnet 102 and magnetic layer 35, the first magnetic force between magnet 101 and magnetic layer 35 is smaller than the second magnetic force between magnet 102 and magnetic layer 35.

For easy explanation, the first and second magnetic forces are simplified as two point forces applied at the right end and the left end of magnetic layer 35 respectively. And for each force, the corresponding first type torque about rotational axis (flexure 34) is simplified as the cross product of a position vector and the magnetic force vector. The position vector is defined in the direction pointing from rotational axis to the corresponding end of magnetic layer 35 where force is applied. Therefore, the first torque about the rotational axis on cantilever 30 caused by the first magnetic force is in counter clockwise direction, and its magnitude is smaller than the second torque in clockwise direction caused by the second magnetic force.

A sum of torque, which is the total sum of all torques about rotational axis applied on cantilever 30, determines the movement of cantilever 30. In this embodiment with a non-magnetic substrate 51 like silicon, the sum of torque is total sum of the first torque caused by the first permanent magnet 101 and the second torque caused by the second permanent magnet 102. Hence, the sum of torque of the first torque and the second torque is in clockwise direction. As a result, Cantilever 30 stays in the closed state with angle β (beta)>90 degrees as shown in FIG. 2B. (It will be discussed later that, when substrate 51 is a soft magnetic material like permalloy, it generates a third magnetic force and a third torque on cantilever 30. Therefore, the sum of torque is the total sum of the first torque caused by the first permanent magnet 101, the second torque caused by the second permanent magnet 102, and the third torque caused by the soft magnetic substrate 51).

Clearly, compared with the north pole of magnet 101, the south pole of magnet 101 contributes the majority of the first torque on cantilever 30 because it contributes the majority of the first magnetic force. Similarly, the south pole of magnet 102 contributes the majority of the second torque.

An example of magnetization of soft magnetic layer 35 at closed state is illustrated in FIG. 2B. Induced by magnets 101 and 102, magnetic moments m1 and m2 point in opposite directions as shown by the arrows. Magnetic moment m2 is slightly stronger than m1 and covers more region of soft magnetic layer 35, due to the narrower gap between magnet 102 and magnetic layer 35.

As mentioned earlier, cantilever 30 also has a second type of torque m×B distributed across the cantilever as long as magnetization in the cantilever and external magnetic field co-exist, where m is the local magnetic moment due to local magnetization in soft magnetic layer 35 and B is the local external magnetic field. Generally, when magnets 101 and 102 are small and close to cantilever 30, the magnetic force and the corresponding first type torque with reference to flexure 34 dominates the movement of cantilever 30. The second type torque is secondary and less important compared with the first type torque. For brevity, the effect of the second type torque is not further discussed separately and it is assumed that the first type torque and second type torque work together in the various embodiments.

The second stable state of cantilever 30 is the stable open state where cantilever 30 tilts such that its left contact 32 is in touch with contact 42 as shown in FIG. 2A.

At the stable open state of FIG. 2A, due to the similar reason, the first magnetic attraction force between magnet 101 and magnetic layer 35 is stronger than the second magnetic attraction force between magnet 102 and magnetic layer 35. Therefore, the first torque on magnetic layer 35 caused by the first magnetic force is in counter clockwise direction, and it is larger than the opposite second torque caused by the second magnetic force. Hence, the sum of torque of the first torque and the second torque is in counter clockwise direction. Consequently, the cantilever stays in the stable open state with angle β (beta)<90 degrees.

An example of magnetization of soft magnetic layer 35 at open state is also illustrated in FIG. 2A by magnetic moments m1 on right side and m2 on left side. Opposite to the closed state, m1 is slightly stronger and covers more region in soft magnetic layer 35 than m2 does. It should be appreciated that the illustrations of the magnetization in magnetic layer 35 in the above examples only reflect a typical setup of the relay. If the parameters of the relay change, the corresponding magnetization in magnetic layer 35 also changes. Parameters include magnet positions, gap between two magnets, magnet size and its magnetization direction, cantilever size, and gap between each magnet and cantilever.

As shown in FIG. 2A, there is a neutral position when cantilever 30 is in the neutral horizontal plane 38, i.e. β (beta)=90 degrees. At this position, magnet 101 and magnet 102 put the same magnetic attraction forces on right side and left side of cantilever 30 respectively. But this equilibrium position is not stable. For example, due to a small perturbation, cantilever 30 tilts clockwise a little bit, the attraction force between magnet 101 and cantilever 30 decreases, while the competing attraction force between magnet 102 and cantilever 30 increases. Therefore, cantilever 30 is forced to rotate clockwise further until its right contact 31 touches contact 41 and stops there. It is similar if the perturbation is in counter-clockwise direction. The imbalance between the attraction forces on left and right side would drive cantilever 30 to rotate further until the left contact 32 hits contact 42 and stops there.

Switching of cantilever 30 from one state to the other is realized by reversing the direction of the sum of torque on cantilever 30. As discussed above, at the stable closed state, the sum of torque on cantilever 30 is in clockwise direction. To switch to the open state, the direction of the sum of torque needs to be reversed to counter clockwise. Similarly, at the stable open state, the sum of torque on cantilever 30 is in counter clockwise direction. To switch to the closed state, the direction of the sum of torque needs to be reversed to clockwise.

As FIG. 2C shows, switching between the open state and the closed state is accomplished by passing a current pulse I in coil 20 to provide a temporary switching magnetic field about cantilever 30. The direction (or polarity) of current pulse I determines the rotation direction and the end state of cantilever 30.

With continued reference to FIG. 2C, cantilever 30 is initially in the closed state. To switch it to the open state, a positive current pulse I with pre-determined magnitude and duration is applied in coil 20 from input end 25 to the output end 26. Following the "right-hand-rule", the induced temporary switching magnetic field B about cantilever 30 points mainly along the positive X-axis direction. If the temporary magnetic filed is strong enough, it magnetizes the entire magnetic layer 35 mainly along its length direction, and creates a temporary magnetic moment m pointing mainly in the positive X-axis direction as shown in FIG. 2C.

The first magnetic force between magnet 101 (dominated by its south pole) and the temporary magnetic moment m of soft magnetic layer 35 is attractive. More accurately, due to enhanced magnetization of magnetic layer 35 by the temporary switching magnetic field, the first magnetic force becomes larger than the original attraction force when the power of coil 20 is off. The increase of the first magnetic force causes the increase of the first torque on cantilever 30 in counter clockwise direction. On the other hand, the second magnetic force between magnet 102 (dominated by its south pole) and the temporary magnetic moment m of soft magnetic layer 35 becomes repulsive. Therefore, the second torque caused by the second magnetic force is also in counter clockwise direction. Clearly, the sum of torque of the first torque and the second torque is in the counter clockwise direction. As a result, cantilever 30 rotates counter-clockwise and contact 31 breaks away from contact 41. With the positive current pulse I flowing in coil 20, cantilever 30 rotates continuously in counter-clockwise direction until its left side contact 32 hits contact 42 and stops there. Hence, switching from the closed state to the stable open state is realized, and the current pulse I in coil 20 is no longer needed to maintain the open state.

It should be appreciated that, during the switching, making the second magnetic force repulsive between magnet 102 and soft magnetic layer 35 is not necessary. It is given as an example for the purpose of easy explanation. In the actual application, during switching, the second magnetic force between magnet 102 and soft magnetic layer 35 may remain attractive. In another word, the local magnetization in left side region of soft magnetic layer 35 may remain in mainly negative X-axis direction but with weakened magnitude caused by the temporary switching magnetic field; while the local magnetization in right side region of soft magnetic layer 35 keeps in positive X-axis direction but with enhanced magnitude caused by the temporary switching magnetic field. As long as the positive current pulse I in coil 20 makes the first magnetic attraction force on the right side of magnetic layer 35 stronger than the second magnetic attraction force on left side, the sum of torque of the first torque and the second torque is in the counter clockwise direction. Cantilever 30 rotates around flexure 34 from closed state to the stable open state. The difference is a less strong current pulse I is applied in coil 20. Hence, slower switching speed of cantilever 30 and lower actuation force will be observed.

To switch cantilever 30 from the stable open state to the closed state, a negative current pulse I with predetermined magnitude and duration is applied in coil 20 from input end 25 to output end 26. As a result, coil 20 generates a temporary switching magnetic field about cantilever 30 mainly pointing in negative X-axis direction. Therefore, a temporary magnetic moment m pointing along the length of magnetic layer 35 is induced, which mainly points in the negative X-axis direction. By the same mechanism discussed above, cantilever 30 rotates clockwise till contact 31 hits contact 41.

The elastic force of flexure 34 is neglected in the above discussions, assuming flexure 34 is flexible and its spring force is smaller than the magnetic forces. The magnetic force on magnetic layer 35 caused by coil 20 when its power is on is also neglected, since it's much smaller than the forces caused by magnets 101 and 102 under normal operation conditions.

Obviously, other type of electromagnet besides the planar coil can also be used to generate the same switching magnetic field to flip the cantilever. For example, a three dimensional wrap-around type coil as shown in FIG. 1C can also be used to replace the planar coil in FIG. 2C.

It should be pointed out that in the analysis of exemplary embodiment of FIG. 2A-D, substrate 51 is assumed to be a regular non-magnetic substrate like silicon or glass. In fact, substrate 51 can also be a soft magnetic material like permalloy. If a permalloy substrate 51 is placed close to cantilever 30 and permanent magnets 101 and 102, the magnetic moments in soft magnetic layer 35 also interacts with permalloy substrate 51. Therefore, magnetic layer 35 sees a third magnetic force and a third torque caused by permalloy substrate 51. The third magnetic force is distributed across soft magnetic layer 35, especially concentrated near its left end and the right end.

The closed state of FIG. 2B is selected to demonstrate the operation of relay 201 with a permalloy substrate 51. When cantilever 30 is in closed state, there is a third magnetic attraction force between soft magnetic layer 35 and permalloy substrate 51. The third magnetic attraction force becomes bigger as insulation layers 52 and 53 are made thinner. Since the right side half of cantilever 30 is closer to substrate 51, the third attraction force is mainly distributed near the right side half of soft magnetic layer 35, especially near contact 31.

Clearly, the third attraction force also contributes to and increases the contact force between contacts 31 and 41. That's one reason why soft magnetic substrate 51 is used in some applications. The third magnetic force on cantilever 30 also contributes a third torque about flexure 34. Obviously, the third torque is in clockwise direction and makes cantilever 30 in the closed state more stable.

To switch cantilever 30 from closed state to the open state, a positive current pulse I is applied in coil 20 as shown in FIG. 2C. As explained before, the current pulse induces a temporary switching magnetic field about cantilever 30 and changes the local magnetizations in magnetic layer 35. If the current I is strong enough, the induced temporary switching magnetic field magnetizes the full magnetic layer 35 in approximately positive X-axis direction as shown in FIG. 2C. Similar to the discussed silicon substrate case, the first magnetic force between magnet 101 and magnetic layer 35 is attractive, and the first torque is in counter clockwise direction. The second magnetic force between magnet 102 and magnetic layer 35 is repulsive, and the second torque is also in counter clockwise direction. The third force and the third torque caused by permalloy substrate 51 during switching are complicated and detailed explanation is needed.

With continued reference to FIG. 2C, before the current pulse I is turned on in coil 20 (i.e. I=0 A), the temporary switching magnetic field is not present. On right side of cantilever 30, the original local magnetic field above the top surface of substrate 51 near contact 41 is mainly caused by magnet 101, and it is approximately in positive Z-axis direction. On left side of cantilever 30, the original local magnetic field above the top surface of substrate 51 near contact 42 is mainly caused by magnet 102 and it is also approximately in positive Z-axis direction. During switching, the positive current pulse I is turned on in coil 20. Following the "right hand rule", the positive current pulse I generates a temporary switching magnetic field similar to the field shown in FIG. 1B. Coil 20 generated magnetic field lines circle the conducting segments 21 in clockwise direction. On right side of cantilever 30, the temporary switching magnetic field is approximately in negative Z-axis direction above the top surface of substrate 51 near contact 41. Therefore, it is in the direction opposite to the original local magnetic field and hence decreases local magnetic field there. While on left side of cantilever 30, the temporary switching magnetic field is approximately in positive Z-axis direction above the top surface of substrate 51 near contact 42. Clearly, it is in the same direction with the original local magnetic field. Therefore, it increases the local magnetic field there.

To summarize, due to the positive current pulse I, the temporary switching magnetic field enhances the local magnetic field near contact 42 (also in the region between contact 32 and contact 42) and decreases local field near contact 41 (also in the region between contact 31 and contact 41). Hence the increase of the local magnetic field in the region near contact 42 increases the local magnetic attraction force between permalloy substrate 51 and left side portion of soft magnetic layer 35. As the magnitude of current pulse I increases, this local attraction force on left side portion of soft magnetic layer 35 also increases. The corresponding torque caused by substrate 51 on left side portion of magnetic layer 35 is in counter clockwise direction, and it increases with the increase of positive current pulse I. On the contrary, the decrease of local magnetic field near contact 41 causes a decrease of the local magnetic attraction force between permalloy substrate 51 and right side portion of magnetic layer 35. As the magnitude of current pulse I increases more, this local attraction force on right side portion of magnetic layer 35 decreases further, as long as the coil 20 generated local field is weaker than the local field generated by magnet 101. The corresponding torque about flexure 34 caused by substrate 51 on right side portion of magnetic layer 35 is in clockwise direction and it also decreases with the increase of positive current pulse I.

From the above analysis and with continued reference to FIG. 2C, the increase of positive current pulse I in coil 20 increases the counter clockwise torque caused by permalloy substrate 51 on left side portion of soft magnetic layer 35, while it decreases the clockwise torque caused by permalloy substrate 51 on right side portion of soft magnetic layer 35. Therefore, when the positive current I is increased to certain magnitude, the third torque, which is the total sum of the torques caused by permalloy substrate 51 on left side and right side portions of soft magnetic layer 35, becomes counter clockwise.

Clearly, if the positive current pulse I is strong enough, the first torque on cantilever 30 by magnet 101, the second torque by magnet 102, and the third torque by permalloy substrate 51 are all in counter clockwise direction. Therefore, cantilever 30 rotates in counter clockwise direction and switches to the open state. In real applications, all three torques in the same counterclockwise direction is not necessary. As long as the sum of torque of the first torque, the second torque and the third torque, is in counterclockwise direction, cantilever 30 rotates from closed state to the open state.

In the design and manufacturing of the relay, one way to make the third force and third torque play less dominant roles on cantilever 30 is to increase the thickness of insulator layer 53. As the distance between cantilever 30 and permalloy substrate 51 increases, the third force and torque caused by permalloy substrate 51 decrease dramatically.

From the above analysis, it appears that switching cantilever 30 is more difficult with a permalloy substrate 51 due to the existence of the third force and the third torque. In reality, compared with the silicon substrate 51, permalloy substrate 51 approximately doubles the magnitude of the temporary switching magnetic field due to its high permeability, if coil 20 is built on a very thin insulator 52 on the permalloy substrate 51. Therefore, switching capability of coil 20 is greatly enhanced by permalloy substrate 51 and the switching of cantilever 30 becomes much easier. That's another reason why in some applications, the permalloy or other soft magnetic substrate 51 is used.

Switching of the same relay with permalloy substrate 51 from open state to closed state is similar to the process discussed above. The only difference is a negative current I pulse is applied in coil 20. The full explanation is omitted here for brevity.

Manufacturing a Latching Relay

Latching relay can be manufactured by common MEMS process techniques, including surface micro-machining or bulk micro-machining. Steps include photo lithography, metallization, dielectric deposition, etching, wafer lapping, wafer bonding and backend packaging. Other manufacturing techniques like screen printing, laser cutting, lamination, layer bonding, welding can also be used in the fabrication.

Alternative Embodiments of Latching Relays

Figure 3:
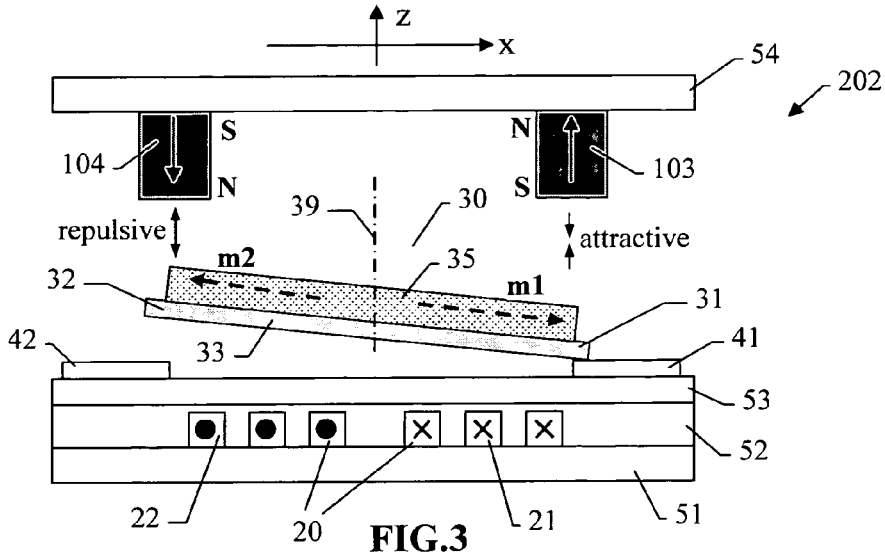
FIG. 3 is a side view of a second exemplary embodiment of the present invention.

FIG. 3 discloses an alternative embodiment of the invention in which the latching relay 202 has a pair of permanent magnets 103 and 104 with opposite directions of permanent magnetization. Magnet 103 has the magnetization in the positive Z-axis direction with its south pole facing the right side end 31 of cantilever 30. Magnet 104 has the magnetization in the negative Z-axis direction with its north pole facing the left side end 32 of cantilever 30. Switching coil 20 is placed such that the right side conducting segments 21 overlap approximately with the right side half of cantilever 30, while the left side segments 22 of coil 20 overlap approximately with the left side half of cantilever 30. The advantage of this embodiment is that it efficiently uses both left side conducting segments 22 and right side conducting segments 21 of planar coil 20. Therefore, the relay area is smaller. Flexure 34 is not shown in FIG. 3 and its location is in the center of the length (along X-axis) of cantilever 30. It is also assumed that, except for their opposite magnetization directions, the two permanent magnets 103 and 104 are identical in size and material, and their distances to the center line 39 of cantilever 30 are also same.

Based on the same physics explained above, relay 202 has two stable states: an open state and a closed state. The actuation mechanism is also similar to that of the embodiment of FIG. 2A except that, during switching, the vector direction of the temporary switching magnetic field near the right side portion of cantilever 30 is approximately opposite to the direction of the temporary switching magnetic field near the left side portion of cantilever 30, which are induced by the current in right side conducting segments 21 and left side conducting segments 22 respectively.

As shown in FIG. 3, cantilever 30 is initially in a closed state with right contact 31 in touch with contact 41. To switch it to the open state, a positive current pulse I with pre-determined magnitude and duration is applied in coil 20. The coil current I flow direction is illustrated by the conductor segments 21 and 22. Following the "right-hand-rule", around the right side of cantilever 30, the temporary switching magnetic field B induced by current I in the right side conductor segments 21 points mainly along the positive X-axis direction. Around the left side of cantilever 30, the temporary switching magnetic field B points mainly along the negative X-axis direction, which is induced by current I in the left side conductor segments 22. If the temporary switching magnetic filed is strong enough, it magnetizes the magnetic layer 35 such that, the magnetization in the right side of the magnetic layer 35 is mainly along its length direction with its temporary magnetic moment m1 pointing mainly in the positive X-axis direction as shown in FIG. 3, while the magnetization in the left side of magnetic layer 35 is mainly along its length direction with its temporary magnetic moment m2 pointing mainly in the negative X-axis direction.

Therefore, on right side of cantilever 30, the south pole of magnet 103 is the dominant magnetic pole and contributes the majority of the first magnetic force. The first magnetic force between magnet 103 and magnetic layer 35 (dominated by the temporary magnetic moment m1) is attractive. To be more accurate, due to enhanced magnetization of magnetic layer 35 by the temporary switching magnetic field, the attraction force between magnet 103 and right side of magnetic layer 35 becomes increased compared with the original attraction force when the power of coil 20 is off. Clearly, the first torque on cantilever 30 about flexure 34 caused by the first magnetic force is in counter clockwise direction.

Meanwhile, with continued reference to FIG. 3, on left side of cantilever 30, the north pole of magnet 104 is the dominant magnetic pole and contributes the majority of the second magnetic force. The second magnetic force between magnet 104 and magnetic layer 35 (dominated by the temporary magnetic moment m2) is repulsive. Therefore, the second torque on cantilever 30 by the second magnetic force is also in counter clockwise direction. Consequently, the sum of torque of the first torque and the second torque is in counter clockwise direction. Therefore, cantilever 30 rotates counter-clockwise about flexure 34 and contact 31 breaks away from contact 41. With the positive current pulse I still flowing in coil 20, cantilever 30 rotates continuously in counter-clockwise direction until its left side contact 32 hits contact 42 and stops there. Hence, cantilever 30 is switched from closed state to the stable open state, and the current pulse I in coil 20 is no longer needed to maintain the open state.

It should be appreciated that, during the switching, making the magnetic force repulsive between magnet 104 and magnetic layer 35 on the left side of cantilever 30 is not necessary. It is given as an example for easy explanation. In the actual application, during the switching, the magnetic force between magnet 104 and magnetic layer 35 may remain attractive. As long as the positive current pulse I in coil 20 makes the first magnetic attraction force between magnet 103 and magnetic layer 35 stronger than the second magnetic attraction force between magnet 104 and magnetic layer 35, the sum of torque of the first torque and the second torque is in counterclockwise direction. Cantilever 30 rotates from closed state to the stable open state. The difference is a less strong current pulse I is applied in coil 20. Hence, the slower switching speed of cantilever 30 and less actuation force will be achieved.

To switch cantilever 30 from the stable open state to closed state, a reversed or negative current pulse I with predetermined magnitude and duration is applied in coil 20. Following the same physics discussed above, cantilever 30 responds to the switching field from coil 20 and rotates clockwise to the closed state. Coil current pulse I can be eliminated after cantilever 30 is switched to the closed state.

Figure 4:
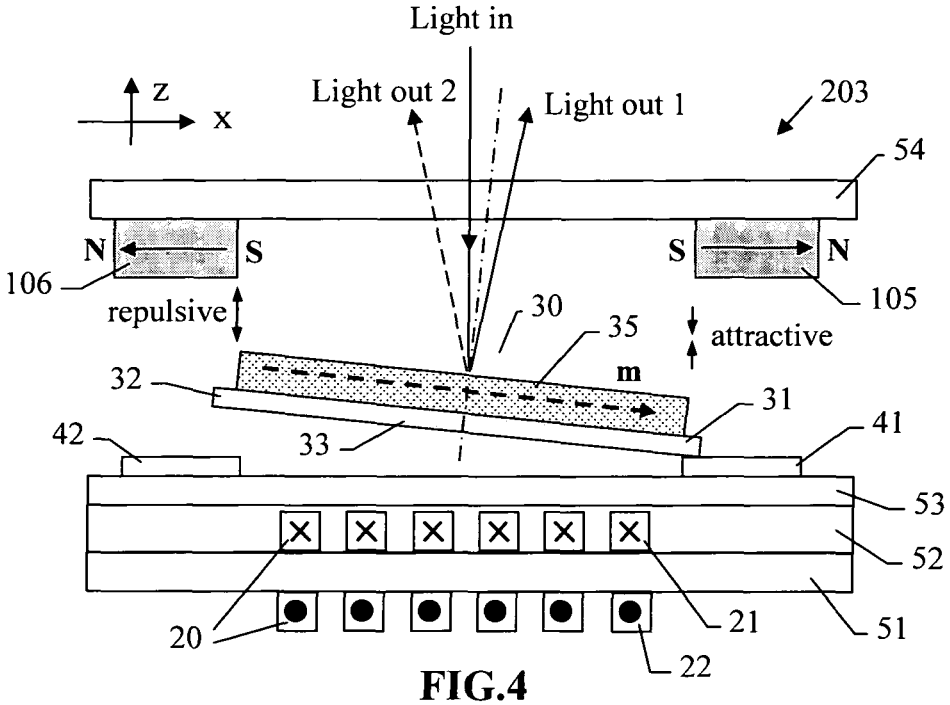
FIG. 4 is a side view of a third exemplary embodiment of the present invention.

FIG. 4 is a side view of another alternative embodiment of the present invention with each of the permanent magnets tilted by ninety degrees or negative ninety degrees compared with the embodiment of FIG. 2A. (in fact, magnets can be tilted at an arbitrary angle). The latching relay 203 has two permanent magnets 105 and 106 with their magnetization in positive X-axis and negative X-axis directions respectively. Magnets 105 and 106 are placed above cantilever 30 with their south poles closer to cantilever 30's right side contact 31 and left side contact 32 respectively, compared with the north poles of the magnets.

The advantage of this embodiment is that magnets 105 and 106 can be much thinner compared with the previous embodiments. Another advantage is magnets can be easily shared by the neighboring relays lined in the X-axis direction in the array design. Switching method is similar to that discussed in the previous embodiment of FIG. 2C. By altering the direction of the current pulse I in coil 20, the cantilever 30 can be switched between two stable states. As shown in FIG. 4, besides being capable of switching electrical signals, relay 203 can also switch or reflect the incident light to the desired output directions, i.e. "Light out 1" direction when cantilever 30 is in closed state, or "Light out 2" direction when cantilever 30 is in the stable open state (not shown in FIG. 4). Apparently, the cantilever can also scan the incident light as a projection mirror within the full angle range between "light out 1" line and "light out 2" line. Therefore, the relay can be used in the fiber optics for light signal switching. It can also be used in the imaging applications for large projection screens.

Figure 5:
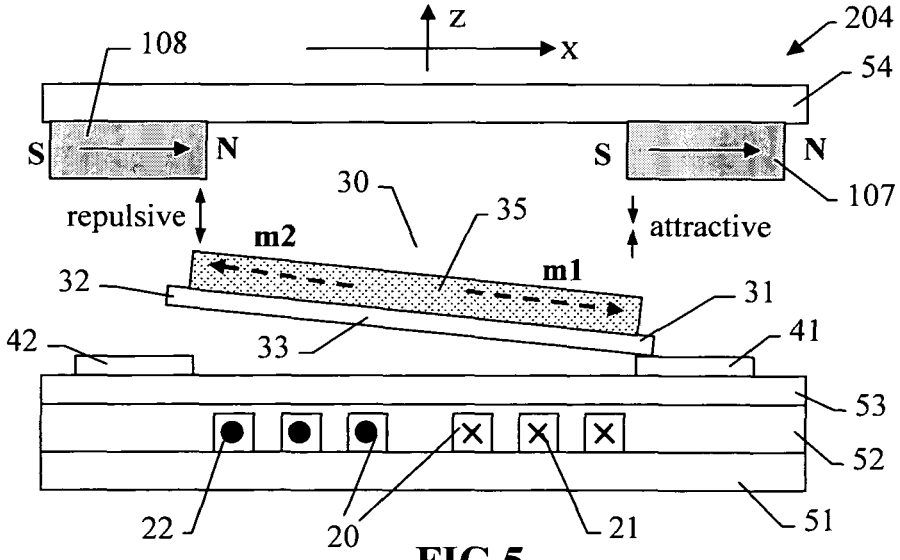
FIG. 5 is a side view of a fourth exemplary embodiment of the present invention.

FIG. 5 is a side view of another alternative embodiment of the present invention. The latching relay 204 has two permanent magnets 107 and 108 with their magnetization both in positive X-axis direction. Magnet 107 is placed above cantilever 30 such that, the south pole of magnets 107 is closer to cantilever 30's right side contact 31 than its opposite north pole. Similarly, the north pole of magnet 108 is closer to left side contact 32 than its opposite south pole. There are at least two advantages of this embodiment. The first one is that magnets 107 and 108 can be much thinner and shared by neighboring relays as discussed before. The second one is it utilizes both sides of conducting segments (right side 21 and left side 22) of coil 20. Therefore, the device occupation area is smaller. Switching method is similar to that of the previous embodiment of FIG. 3. By altering the direction of the current pulse I in coil 20, cantilever 30 can be switched between two stable states. No power in coil 20 is further needed after the cantilever is switched to the target state.

Figure 6:
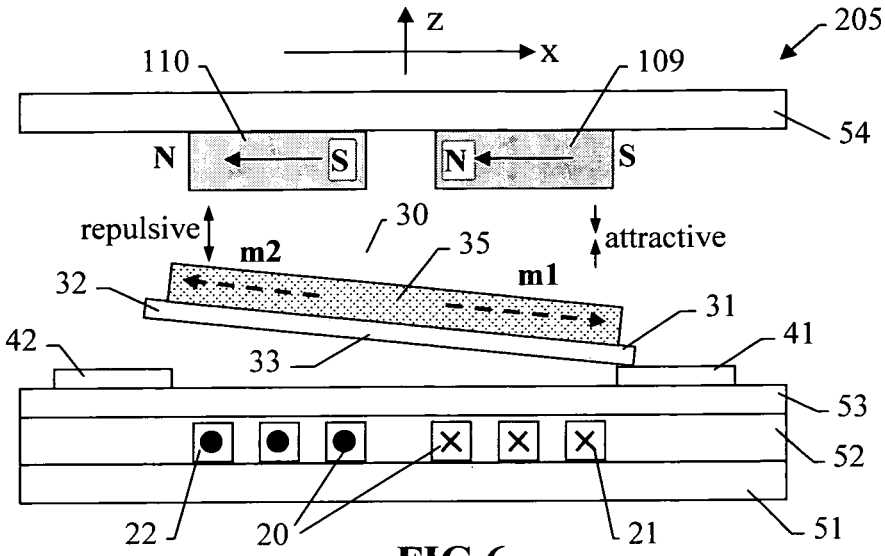
FIG. 6 is a side view of a fifth exemplary embodiment of the present invention.

FIG. 6 is a side view of another alternative embodiment of the present invention. The latching relay 205 has two permanent magnets 109 and 110 with their magnetization both in negative X-axis direction. The key feature of this embodiment is that Magnets 109 and 110 are placed much closer to each other compared with the previous embodiments. Magnet 109 is placed with its south pole near the right contact 31 of cantilever 30 and north pole close to the center of cantilever 30. Magnet 110 is placed with its north pole near the left contact 32 of cantilever 30 and south pole close to the center of cantilever 30. Due to the position difference, the magnetic force between the south pole of magnet 109 and magnetic layer 35, and the magnetic force between the north pole of magnet 110 and magnetic layer 35 dominate the operation of cantilever 30 during switching and after switching.

The magnetic force between the north pole of magnet 109 and magnetic layer 35, and the magnetic force between the south pole of magnet 110 and magnetic layer 35 are less important in the operation of the relay. Since the two opposite poles are close to each other, to certain level, they cancel each other's magnetic field near cantilever 30. The closer they get, the more they cancel each other. Operation mechanism of relay 205 is similar to that of embodiment of FIG. 5. By applying positive or negative current pulses in coil 20, cantilever 30 can be switched from one of its two stable states to the other.

Figure 7:
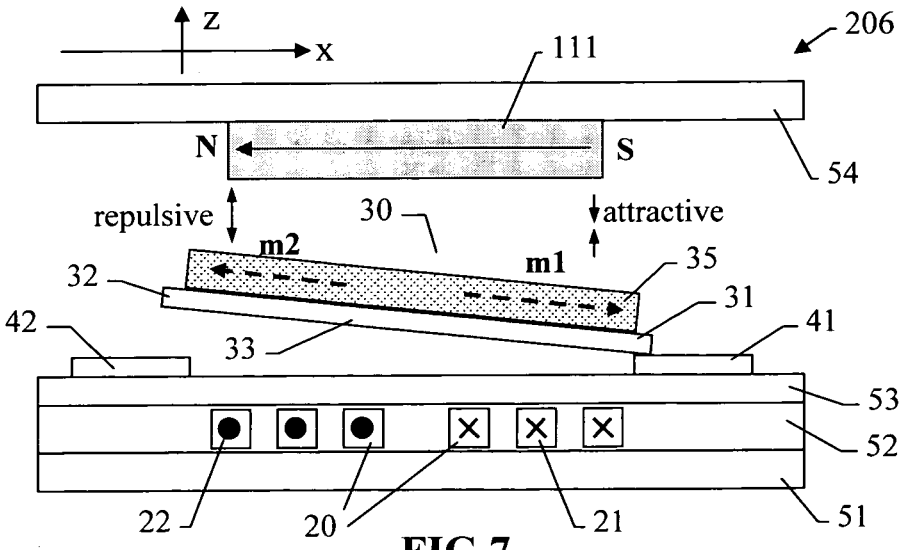
FIG. 7 is a side view of a sixth exemplary embodiment of the present invention.

FIG. 7 is another embodiment in which magnet 111 is a full piece with its magnetization pointing in negative X-axis direction. Relay 206 is an extreme case of the FIG. 6 embodiment in which the two magnets 109 and 110 get so close that the north pole of magnet 109 touches the south pole of magnet 110, and function as one full magnet. The operation mechanism is similar to that of the embodiment of FIG. 6 or FIG. 5.

It should be pointed out that in the analysis of various alternative embodiments mentioned above, substrate 51 is assumed to be regular MEMS substrate like glass or silicon. In fact, substrate 51 can also be a soft magnetic material like permalloy, iron, nickel, nickel-cobalt and the like. Or it can be a regular substrate like silicon coated with soft magnetic material layer like permalloy (e.g. 10 microns of electroplated permalloy). Benefits of using soft magnetic substrate 51 are: enhanced switching capability of electromagnet 20 due to enhanced temporary switching magnetic field, increased contact force between contacts 31 and 41 (or between contacts 32 and 42), faster switching speed of cantilever 30 due to enhanced magnetization in magnetic layer 35, extra magnetic field shielding, faster heat dissipation as a metal, higher tolerance of design and process variation.

For various embodiments discussed above, each end of cantilever 30 is essentially controlled by a dominant magnetic pole of a permanent magnet. To keep the magnetic interference low on neighboring relays or other nearby magnetic device, the permanent magnet sizes need to be small. To make each dominant magnetic pole produce a larger force and torque on cantilever 30 so that the relay performs more efficiently, it is preferred to position each dominant magnetic pole close to each end of cantilever. Therefore, the size of each permanent magnet, the relative distance between each dominant magnetic pole and cantilever 30 which is a greater than zero distance, and the distance between two dominant magnetic poles which is also a greater than zero distance, are important parameters in the design.

Figure 8:
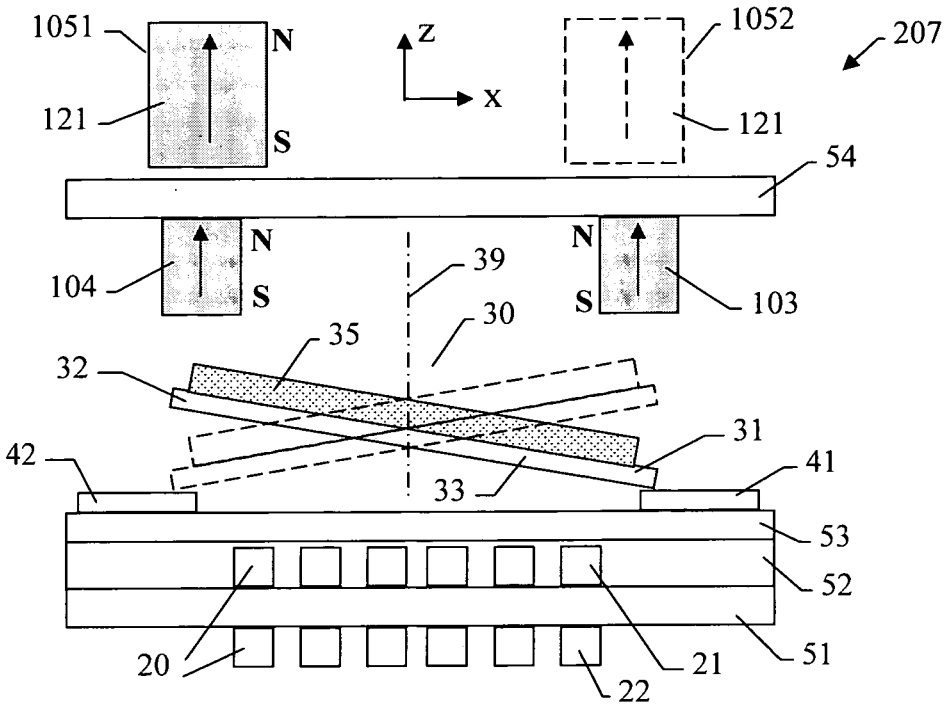
FIG. 8 is a side view of a seventh exemplary embodiment of the present invention.

Yet, it should be pointed out that to switch the relay, using electromagnet or coil to generate the switching magnetic field is only one of the ways to operate the device. Other methods may also be used to provide the switching magnetic field. For example, besides the two permanent magnets 103 and 104 as shown in FIG. 8, a third moveable permanent magnet 121 can also provide the switching magnetic field when it approaches, leaves, or swipes near the moveable cantilever. The presence of the third moveable magnet changes the magnetization of the soft magnetic layer 35. It also changes the forces and torques on the cantilever 30. Therefore, the cantilever rotates accordingly.

This method is quite useful in the position sensing applications. Due to its small dimension, high sensitivity and fast speed, this type of relay can provide much higher precision of position detection than the conventional reed relays. For the two stationary magnets and the third moveable magnet, there are many combinations in the design in terms of magnet size, magnetization orientation, material strength and relative positions. For brevity, only one exemplary embodiment of FIG. 8 is selected to demonstrate the operation of the device.

In FIG. 8, when the third moveable permanent magnet 121 is far away, cantilever 30 has two stable states as discussed in the previous embodiments. When magnet 121 approaches the relay to position 1051 as shown in the figure, because magnet 121 is magnetized in the same direction as the other two magnets 104 and 103, the magnetic attraction force on left side of cantilever 30 is increased compared with the force without magnet 121. If the increase of the force is significant enough, no matter what the initial state of cantilever 30 is in, it forces the cantilever 30 to be in the closed state with contact 31 in touch with contact 41.

Conversely, if magnet 121 moves from position 1051 in positive X-axis direction to another position 1052 as shown with broken lines, the magnetic attraction force on right side of cantilever 30 becomes much stronger, and forces cantilever 30 to rotate to the open state with contact 32 in touch with contact 42 (shown by the broken lines of cantilever 30). Relay 207 keeps the open state if magnet 121 moves away from position 1052 in the positive X-axis direction or positive Z-axis direction. But if it moves away from position 1052 in the negative X-axis direction and cross the position 1051 again, cantilever 30 flips from the open position back to the closed position with contact 31 in touch with contact 41. Clearly, this relay is quite unique that it can sense both the position and the moving direction of magnet 121 by measuring which state the cantilever is in after switching.

It should be pointed out that magnet 121 can switch cantilever 30 to closed state when it's in a small region surrounding position 1051 instead of in a single spot of position 1051. For easy description, a single spot position 1051 is used to explain the function of magnet 121. It is the same reason that single position 1052 is used to represent the small region where magnet 121 switches cantilever 30 to the open state.

With continued reference to FIG. 8, single relay 207 can also measure the speed of magnet 121 with proper preconditioning. For example, to measure the speed of magnet 121 moving in from far right side in the direction of negative X-axis, cantilever 30 is pre-set into closed state with contact 31 in touch with contact 41. When magnet 121 passes position 1052, cantilever flips to open state at time t1; when magnet 121 moves continuously and passes position 1051, the cantilever flips to closed state at time t2. By measuring the distance between position 1052 and position 1051, and the time difference between time t1 and t2, one can easily estimate the speed of magnet 121. By characterizing the relay in detail, the cantilever 30 flipping time (cantilever travel time from closed state to open state or the opposite) can also be calibrated and included in the magnet 121 speed measurements. As a result, the accuracy of the measurement will be much higher.

Of course, if multiple relays lined up in series are used, the speed at each test point, moving direction and even the acceleration of magnet 121 can be measured accurately. The multiple relays could be individual relays packaged separately. They could also be relays fabricated on a single die and packaged in a single chip.

It should be pointed out that, for this particular embodiment of FIG. 8, magnet 121 can also be magnetized in negative Z-axis direction with its north pole pointing in negative Z-axis (not illustrated in FIG. 8). The result is opposite to what is discussed above. For example, instead of enhancing the magnetic attraction force, magnet 121 weakens the magnetic attraction force on cantilever 30's left side when it is in position 1051 due to its opposite magnetization to magnet 104 (assuming magnet 121's own attraction force is not strong enough to dominate cantilever movement, the other case of extremely strong magnet 121 will be discussed further). Therefore, cantilever 30 is forced to be in open state with contact 32 in touch with contact 42. Similarly, when magnet 121 is in position 1052, cantilever 30 will be force to be in the closed state.

As mentioned above, in case magnet 121 is far stronger than magnet 103 and 104, it dictates the movement of cantilever 30 and the result is different again. When magnet 121 is in position 1051, the dominant attraction force on cantilever 30 from magnet 121 attracts cantilever 30 in closed state with contact 31 in touch with contact 41. While when magnet 121 is in position 1052, its dominant attraction force keeps the cantilever 30 in open state with contact 32 in touch with contact 42.

In the embodiment of FIG. 8, coil 20 is optional as relay 207 can operate independently without coil 20. But by providing the electromagnet of coil 20, relay 207 can be set (preset before measurement or reset after measurement) into one of two stable states by applying the positive or negative current pulse I with predetermined magnitude and duration in coil 20. Therefore, its initial and final state can be selectively controlled, which is very important in the industrial control system.

Moveable magnet 121 can also be arranged at the bottom of relay 207 to switch cantilever 30. The operation principle is similar. For brevity, detailed examples are omitted.

The embodiment of FIG. 8 provides two stable states when moveable magnet 121 is far away from the relay 207. Some simple applications only need a relay with one stable state, i.e. normally on or normally off. This can be done by making one of the two stationary permanent magnets moveable.

Figure 9:
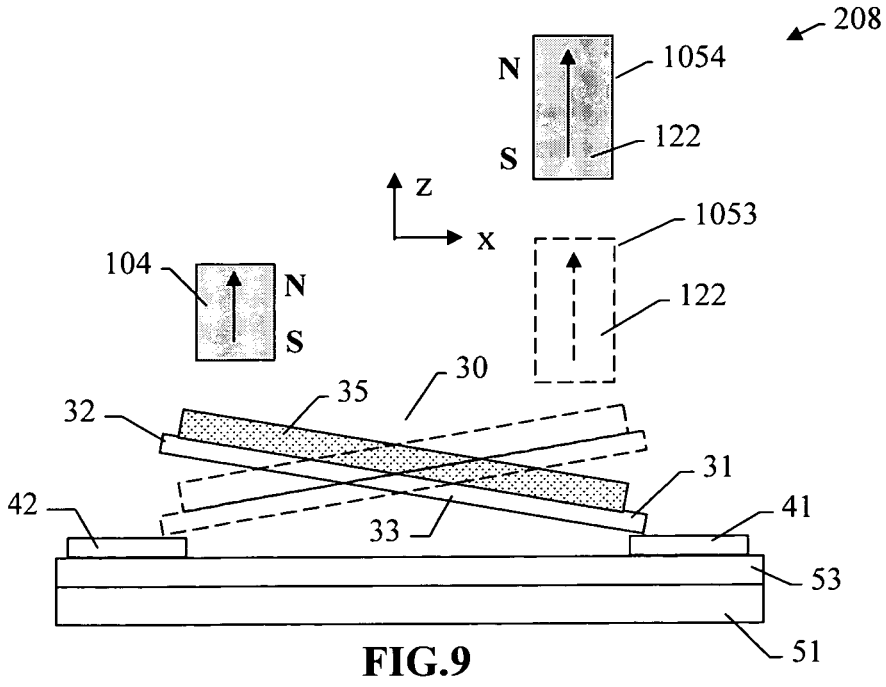
FIG. 9 is a side view of an eighth exemplary embodiment of the present invention.

As shown in FIG. 9, relay 208 has a stationary permanent magnet 104 and a moveable permanent magnet 122. When moveable magnet 122 is far away or in a distant position 1054, the stationary magnet 104 attracts and holds cantilever 30 in the closed state with contact 31 in touch with contact 41. When moveable magnet 122 moves to position 1053, the attraction force on cantilever 30 from magnet 122 is stronger than the attraction force from magnet 104. Assuming the rotation axis is in the center of cantilever 30, therefore, the cantilever rotates from the closed state to open state. In this embodiment, relay 208 is an electrically normally-on type, and it senses the proximity position of the moveable magnet 122 by measuring conductivity between contact 31 and contact 41. Of course, by removing the contacts 31 and 41 and keeping the contacts 32 and 42, the same relay is an electrically normally-off type and the magnet 122's position is sensed by measuring the conductivity between contact 32 and contact 42.

Magnet 122 can also switch cantilever 30 when it's placed under the bottom of substrate 51 (not shown in FIG. 9). When it moves close under contact 32 and 42, its strong attraction force pulls cantilever 30 downward and makes contacts 32 and 42 in touch.

Certainly, magnet 104 can also be placed under substrate 51 near contacts 32 and 42. Correspondingly, moveable magnet 122 also has one switching position under substrate 51 when it's near contacts 31 and 41, and the other switching position above cantilever 30 near contacts 32 and 42.

Besides the position detection of moveable magnet 122, relay 208 can also be used to measure the speed, direction and acceleration of moveable magnet 122 or its associated object by using multiple relays in the measurement. For example, three relays are disposed at three different positions d1, d2, d3 on a straight line. A moving magnet 122 passes each of three relays at three different times of t1, t2, and t3. By solving the motion equations, one skilled in the art can easily find the speeds of magnet 122 at position d1, d2 and d3, and the average linear acceleration. These three relays could be three individual relays packaged separately. They could also be three relays fabricated on a single die packaged in a single chip.

Figure 10:
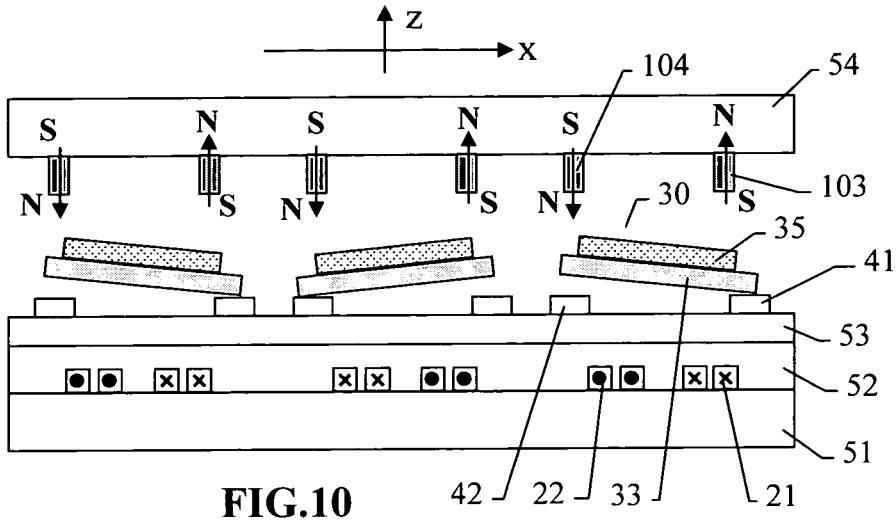
FIG. 10 is a side view of an array of relays according to embodiments of the present invention.
Figure 11:
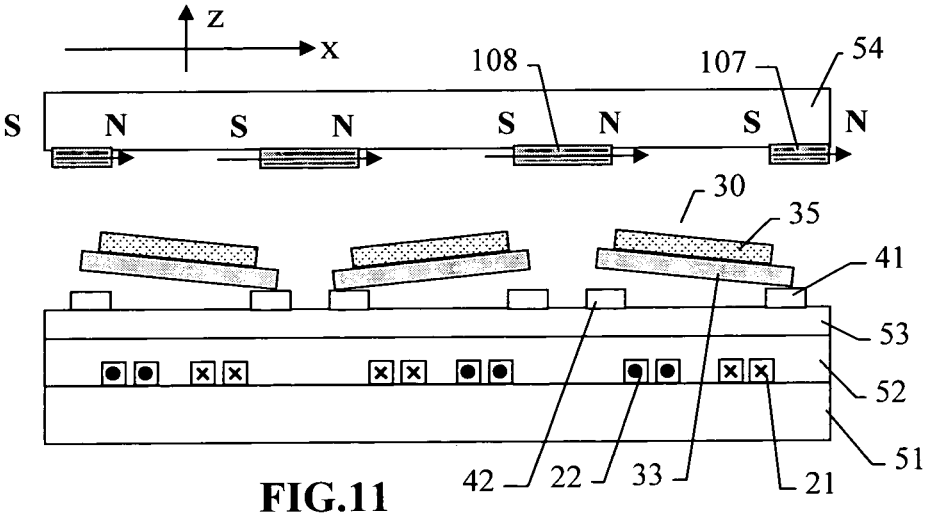
FIG. 11 is a side view of an array of relays with shared magnets in X-axis direction according to embodiments of the present invention.

Arrays of latching relay can be easily made by repeating a basic relay unit of each embodiment in X-axis direction and Y-axis direction with proper wiring of signal paths. FIG. 10 shows an example of an array with repetition in X-axis direction. As mentioned previously, Magnets can also be shared by neighboring relays in the array application. FIG. 11 shows a side view of an array of latching relays with magnets being shared by neighboring cantilevers in X-axis direction.

CONCLUSION

It will be understood that many other embodiments could be formulated without departing from the scope of the invention. For example, a single-throw relay could be created by removing a contact 42 that comes into contact with cantilever 30 when the cantilever is in its open state. Similarly, various topographies and geometries of relay could be formulated by varying the layout of the various components (such as flexure 34, magnetic layer 35, and conducting layer 33). Multiple or bi-forked contacts can also be used at each end of cantilever 30 for higher contact reliability. Conductive contacts 31 and 32 on cantilever 30 can also be further insulated from cantilever 30 with an insulator layer for better RF performance. Each of stationary contacts 41 and 42 on substrate can also be split into two contacts in some situations for better device performance like isolation. Relay can be further protected by adding magnetic shielding material like permalloy, etc.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given in the disclosure.

REFERENCE

[1] U.S. Pat. No. 5,818,316, Shen et al.
[2] U.S. Pat. No. 6,124,650, Bishop et al.

[3] U.S. Pat. No. 7,106,159, Delamare et al.
[4] U.S. Pat. No. 7,482,899, Shen et al.
[5] U.S. Pat. No. 6,469,602 B2, Ruan et al.
[6] U.S. Pat. No. 6,469,603 B1, Ruan et al.
[7] U.S. Pat. No. 5,475,353, Roshen et al.
[8] U.S. Pat. No. 5,703,550, Pawlak et al
[9] U.S. Pat. No. 5,847,631, Taylor and Allen.
[10] U.S. Pat. No. 5,889,452, Vuilleumier.
[11]. U.S. Pat. No. 5,945,898, Judy et al.
[12] U.S. Pat. No. 6,084,281, Fullin et al.
[13] U.S. Pat. No. 6,094,116, Tai et al.
[14] U.S. Pat. No. 6,492,887, Diem et al.
[15] U.S. Pat. No. 6,633,158, Shen et al.
[16] U.S. Pat. No. 6,794,965, Shen et al.
[17] U.S. Pat. No. 7,301,334, Shen et al.
[18] U.S. Pat. Pub. No. 20050007218, Shen et al.
[19] U.S. Pat. No. 5,872,496, Asada et al.
[20] U.S. Pat. No. 5,557,132, Takahashi, Masazi.
[21] U.S. Pat. Pub. No. 20100141366, Sprague et al.
[22] U.S. Pat. Pub. No. 2008/0231930, Mizoguchi et al.
[23] U.S. Pat. No. 8,159,320, Ruan et al.

What is claimed is:

1. A proximity sensing system comprising:

a sensor having at least one switch, said switch including:

(a). a substrate;

(b). contacts supported by said substrate;

(c). a moveable element attached to said substrate having a rotational axis, said moveable element comprising a soft magnetic material and having a first end and a second end, said moveable element being configured to have two stable positions corresponding to two states: a first state and a second state;

(d). a first permanent magnet disposed near said first end of said moveable element to produce a first magnetic attraction force on said moveable element and a first torque about said rotational axis, characterized in that said first permanent magnet forces said first end of said moveable element to tilt toward said first permanent magnet about said rotational axis, maintaining said moveable element in said first state;

and a second movable magnet disposed in a switching position to produce a second magnetic attraction force and a second torque about said rotational axis with predetermined magnitude and direction on said movable element to force one of said first end and said second end to move toward said second moveable magnet, forcing said first end of said moveable element to move away from said first permanent magnet, switching said moveable element from said first state to said second state;

wherein said movable element returns from said second state to said first state when said second moveable magnet moves out of said switching position, and when said second moveable magnet moves relative to said sensor, said moveable element interacts with a respective one of said contacts based on the position of said second moveable magnet during movement.

2. The system of claim 1, wherein said switch is configured as a normally-on micro-magnetic switch.

3. The system of claim 1, wherein said switch is configured as a normally-off micro-magnetic switch.

4. The system of claim 1, wherein a position of an object associated with said second moveable magnet is determined based on signals generated when said moveable element interacts with one or more of the respective one of said contacts.

5. The system of claim 1, wherein a distance between an object associated with said second moveable magnet and said sensor is determined based on signals generated when said moveable element interacts with one or more of the respective one of said contacts.

6. The system of claim 1, wherein a velocity of an object associated with said second moveable magnet with respect to said switch is determined based on signals generated when said moveable element interacts with one or more of the respective ones of said contacts.

7. The system of claim 1, wherein an acceleration of an object associated with said second moveable magnet with respect to said switch is determined based on signals generated when said moveable element interacts with one or more of the respective ones of said contacts.

8. The system of claim 1, wherein a moving direction of an object associated with said second moveable magnet with respect to said switch is determined based on signals generated when said moveable element interacts with one or more of the respective ones of said contacts.

9. The system of claim 1, wherein said sensor includes an array of said switches.

10. The system of claim 1, wherein said sensor includes an one-dimensional array of said switches.

11. The system of claim 1, wherein said sensor includes a two-dimensional array of said switches.

12. The system of claim 1, wherein said sensor includes a three-dimensional array of said switches.

13. The system of claim 1, wherein said second moveable magnet is a permanent magnet.

14. The system of claim 1, wherein said second moveable magnet is an electromagnet.

15. A method of operating a proximity sensing system comprising the steps of:

providing a sensor having at least one switch, which further includes steps of providing said switch by:

(a). providing a substrate;

(b). providing contacts supported by said substrate;

(c). providing a moveable element attached to said substrate having a rotational axis, said moveable element comprising a soft magnetic material and having a first end and a second end, said moveable element being configured to have two stable positions corresponding to two states: a first state and a second state;

(d). providing a first permanent magnet, placing said first permanent magnet near said first end of said moveable element to produce a first magnetic attraction force on said moveable element and a first torque about said rotational axis, characterized in that said first permanent magnet forces said first end of said moveable element to tilt toward said first permanent magnet about said rotational axis, maintaining said moveable element in said first state; and providing a second moveable magnet, moving said second moveable magnet in and out of a switching position, and switching said moveable element between said two states;

wherein said second movable magnet, when disposed in said switching position, produces a second magnetic attraction force and a second torque about said rotational axis with predetermined magnitude and direction on said movable element to force one of said first end and said second end to move toward said second moveable magnet, forcing said first end of said moveable element to move away from said first permanent magnet, switching said moveable element from said first state to said second state; said movable element returns from said second state to said first state when said second moveable magnet moves out of said switching position, and when said second moveable magnet moves relative to said sensor, said moveable element interacts with a respective one of said contacts based on the position of said second moveable magnet during movement.

16. The method of claim 15, further comprising a step of measuring a position of an object associated with said second moveable magnet with respect to said switch based on signals generated when said moveable element interacts with one or more of the respective ones of said contacts.

17. The method of claim 15, further comprising a step of measuring a velocity of an object associated with said second moveable magnet with respect to said switch based on signals generated when said moveable element interacts with one or more of the respective ones of said contacts.

18. The method of claim 15, further comprising a step of measuring an acceleration of an object associated with said second moveable magnet with respect to said switch based on signals generated when said moveable element interacts with one or more of the respective ones of said contacts.

19. The method of claim 15, further comprising a step of measuring a moving direction of an object associated with said second moveable magnet with respect to said switch based on signals generated when said moveable element interacts with one or more of the respective ones of said contacts.

20. The method of claim 15, further comprising a step of providing an array of said switch of said sensor.

* * * * *